US010914500B2

(12) United States Patent
Aranda et al.

(10) Patent No.: US 10,914,500 B2
(45) Date of Patent: Feb. 9, 2021

(54) ICE-MAKING APPLIANCE

(71) Applicant: WHIRLPOOL CORPORATION, Benton Harbor, MI (US)

(72) Inventors: Jose R. Aranda, Stevensville, MI (US); Darci Cavali, Saint Joseph, MI (US); Chao-Yi Chen, Saint Joseph, MI (US); Milind Devle, Pune (IN); Dewei Guan, Stevensville, MI (US); Benjamin G. Jimenez, Burns Harbor, IN (US); Varun Deepak Kotecha, Pune (IN); Rishikesh Vinayak Kulkarni, Pune (IN); Mahalingappa Mulimani, Pune (IN); N S Ayodhya Ram, Pune (IN); Rogerio Rodrigues, Jr., Saint Joseph, MI (US); Anuj Sharma, Saint Joseph, MI (US); Richard A. Spletzer, Saint Joseph, MI (US); Shailesh Wani, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 121 days.

(21) Appl. No.: 16/209,713

(22) Filed: Dec. 4, 2018

(65) Prior Publication Data

US 2019/0145684 A1 May 16, 2019

Related U.S. Application Data

(63) Continuation-in-part of application No. 15/810,470, filed on Nov. 13, 2017, now Pat. No. 10,739,053.

(51) Int. Cl.

| | |
|---|---|
| ***F25C 1/24*** | (2018.01) |
| ***F25C 1/04*** | (2018.01) |
| ***F25C 5/06*** | (2006.01) |

(52) U.S. Cl.

CPC ..... *F25C 1/24* (2013.01); *F25C 1/04* (2013.01); *F25C 5/06* (2013.01); *F25C 2400/10* (2013.01); *F25C 2500/08* (2013.01); *F25C 2700/12* (2013.01); *F25D 2317/063* (2013.01)

(58) Field of Classification Search

CPC ..... F25C 1/24; F25C 1/04; F25C 2400/10; F25C 2500/08; F25D 2317/063

See application file for complete search history.

(56) References Cited

U.S. PATENT DOCUMENTS

| | | | |
|---|---|---|---|
| 7,464,565 | B2 | 12/2008 | Fu |
| 7,487,645 | B2 | 2/2009 | Sasaki et al. |
| 7,870,755 | B2 | 1/2011 | Hsu et al. |
| 8,375,739 | B2 | 2/2013 | Kim et al. |

(Continued)

FOREIGN PATENT DOCUMENTS

| | | | |
|---|---|---|---|
| WO | 2017039334 | A1 | 3/2017 |

*Primary Examiner* — Ana M Vazquez

(74) *Attorney, Agent, or Firm* — Price Heneveld LLP

(57) ABSTRACT

An icemaker for a refrigerated appliance is provided. The icemaker includes an ice tray having a plurality of ice-forming compartments and a duct for directing chilled air operably coupled with a diverter. The diverter includes a base having first and second sides and defining a plurality of variously sized slots. A centerline of the base is aligned with a centerline of the ice tray. At least one spacing portion extends between two of the plurality of variously sized slots. A plurality of fins extend away from a top surface of the base.

20 Claims, 14 Drawing Sheets

(56) References Cited

U.S. PATENT DOCUMENTS

| | | | | |
|---|---|---|---|---|
| 8,677,776 | B2 | 3/2014 | Kim et al. | |
| 8,707,726 | B2 | 4/2014 | Lim et al. | |
| 8,820,108 | B2 | 9/2014 | Oh et al. | |
| 9,217,595 | B2 | 12/2015 | Kim et al. | |
| 9,228,769 | B2 | 1/2016 | Kim et al. | |
| 9,829,235 | B2 | 11/2017 | Visin | |
| 9,879,896 | B2 | 1/2018 | Koo | |
| 2009/0178428 | A1 | 7/2009 | Cho et al. | |
| 2010/0163707 | A1 | 7/2010 | Kim | |
| 2010/0313594 | A1* | 12/2010 | Lee | F25D 17/062 62/340 |
| 2015/0308724 | A1* | 10/2015 | Camacho Velazquez | F25C 1/24 62/344 |
| 2017/0074572 | A1 | 3/2017 | Visin | |
| 2017/0314841 | A1* | 11/2017 | Koo | F25C 1/04 |

* cited by examiner

ICE-MAKING APPLIANCE

CROSS-REFERENCE TO RELATED APPLICATION

This application is a continuation in part of and claims priority to U.S. patent application Ser. No. 15/810,470, filed Nov. 13, 2017, entitled ICE-MAKING APPLIANCE. The aforementioned related application is hereby incorporated by reference in its entirety.

FIELD OF THE DISCLOSURE

The present disclosure generally relates to an ice-making appliance, and more specifically to an ice-making appliance having a diverter.

BACKGROUND

Ice-making assemblies are commonly disposed within refrigerated appliances. It is therefore desired to develop ice-making appliances and assemblies for creating airflow that reaches the cubes equally within the ice-making appliance for ensuring a uniform ice formation rate.

BRIEF SUMMARY OF THE DISCLOSURE

In at least one aspect, an icemaker for a refrigerated appliance is provided that includes an ice tray having a top surface and a plurality of ice-forming compartments arranged along a central axis. A duct for directing chilled air is operably coupled with a diverter. The diverter includes a base spaced away from the top surface of the ice tray and having first and second sides. The base defines a plurality of variously sized slots. The slots are offset from a central axis of the ice tray. At least one spacing portion extends between two of the plurality of variously sized slots. A plurality of fins extend away from a top surface of the base.

In at least another aspect, an icemaker for a refrigerated appliance is provided. The icemaker includes an ice tray having a top surface and a plurality of ice-forming compartments arranged along a central axis. A duct system has upper and lower baffles. The upper baffle directs chilled air above the ice tray. A diverter is positioned parallel above and spaced apart from the ice tray and defining a plurality of slots therein. The plurality of slots are offset from the central axis of the ice tray.

In yet another aspect, a method for forming ice is provided. The method includes a step of generating chilled air. The method also includes a step of coupling a duct system having a plurality of fins with a diverter. Another step of the method includes positioning the diverter over an ice tray having a plurality of ice forming compartments. The method further includes a step of filling the plurality of ice forming compartments with water. Another step of the method includes forcing the chilled air through the duct system, over the plurality of fins, and through the diverter such that the chilled air is unevenly distributed through the diverter in a predetermined pattern.

These and other features, advantages, and objects of the present device will be further understood and appreciated by those skilled in the art upon studying the following specification, claims, and appended drawings.

DETAILED DESCRIPTION

Figure 1:
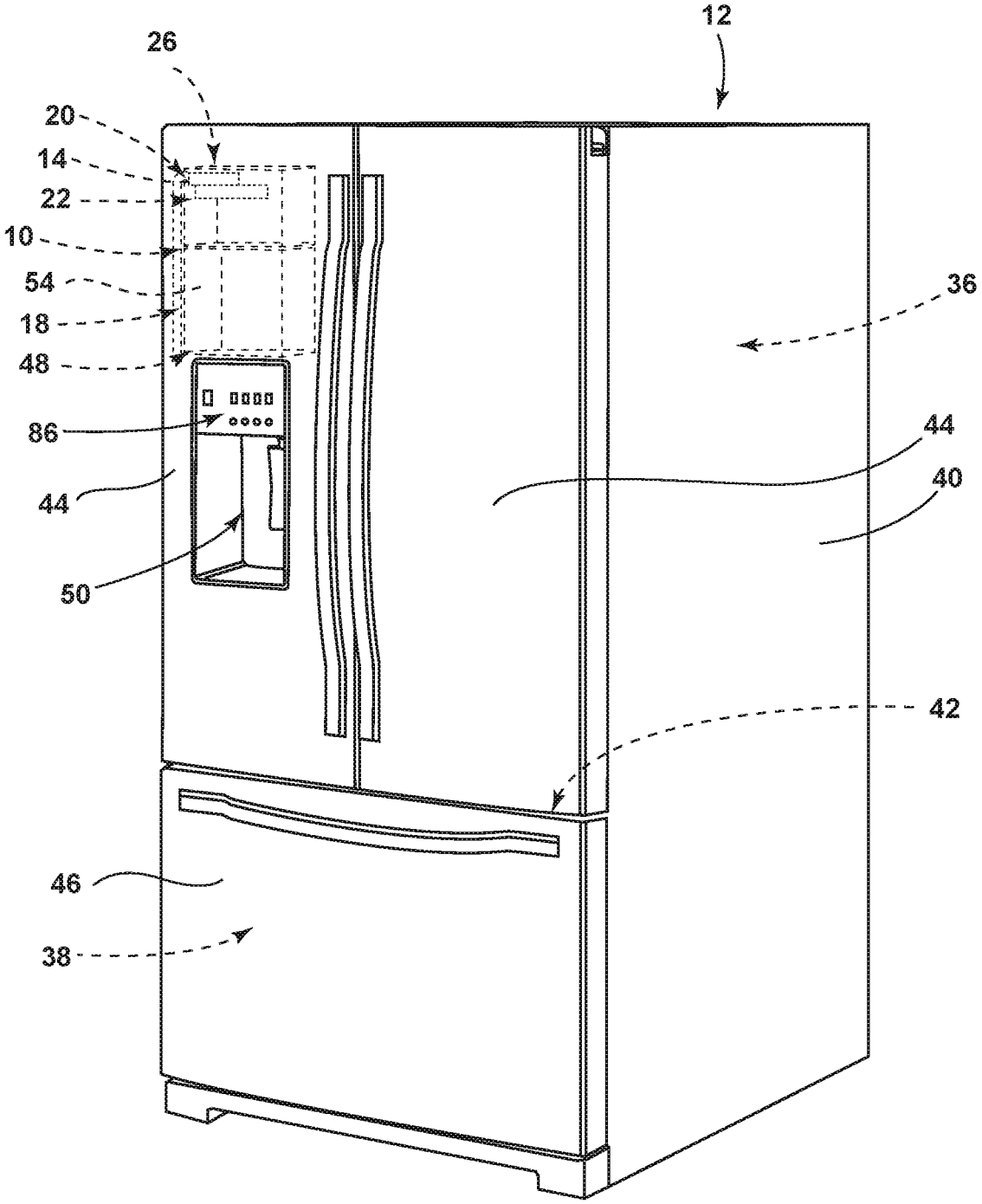
FIG. 1 is a front perspective view of a refrigerated appliance incorporating an icemaker.

For purposes of description herein, the terms "upper," "lower," "right," "left," "rear," "front," "vertical," "horizontal," and derivatives thereof shall relate to the disclosure as oriented in FIG. 1. However, it is to be understood that the disclosure may assume various alternative orientations, except where expressly specified to the contrary. It is also to be understood that the specific devices and processes illustrated in the attached drawings, and described in the following specification are simply exemplary examples of the inventive concepts defined in the appended claims. Hence, specific dimensions and other physical characteristics relating to the examples disclosed herein are not to be considered as limiting, unless the claims expressly state otherwise.

As required, detailed examples of the present disclosure are disclosed herein. However, it is to be understood that the disclosed examples are merely exemplary of the disclosure that may be embodied in various and alternative forms. The figures are not necessarily to a detailed design and some schematics may be exaggerated or minimized to show function overview. Therefore, specific structural and functional details disclosed herein are not to be interpreted as limiting, but merely as a representative basis for teaching one skilled in the art to variously employ the present disclosure.

In this document, relational terms, such as first and second, top and bottom, and the like, are used solely to distinguish one entity or action from another entity or action, without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

With reference to FIGS. 1-10, an icemaker 10 for a refrigerated appliance 12 is provided herein. The icemaker 10 includes an ice tray 14 having a plurality of ice-forming compartments 16. A duct system 18 has upper and lower baffles 20, 22. The upper baffle 20 directs chilled air 24 above the ice tray 14 and the lower baffle 22 directs the chilled air 24 below the ice tray 14. A deflector 26 is operably coupled with the upper baffle 20. The deflector 26 has a transition portion 28 offset from a body portion 30. A diverter 32 is disposed between the deflector 26 and the ice tray 14. The deflector 26 defines a plurality of variously sized slots 34 therein.

Figure 2:
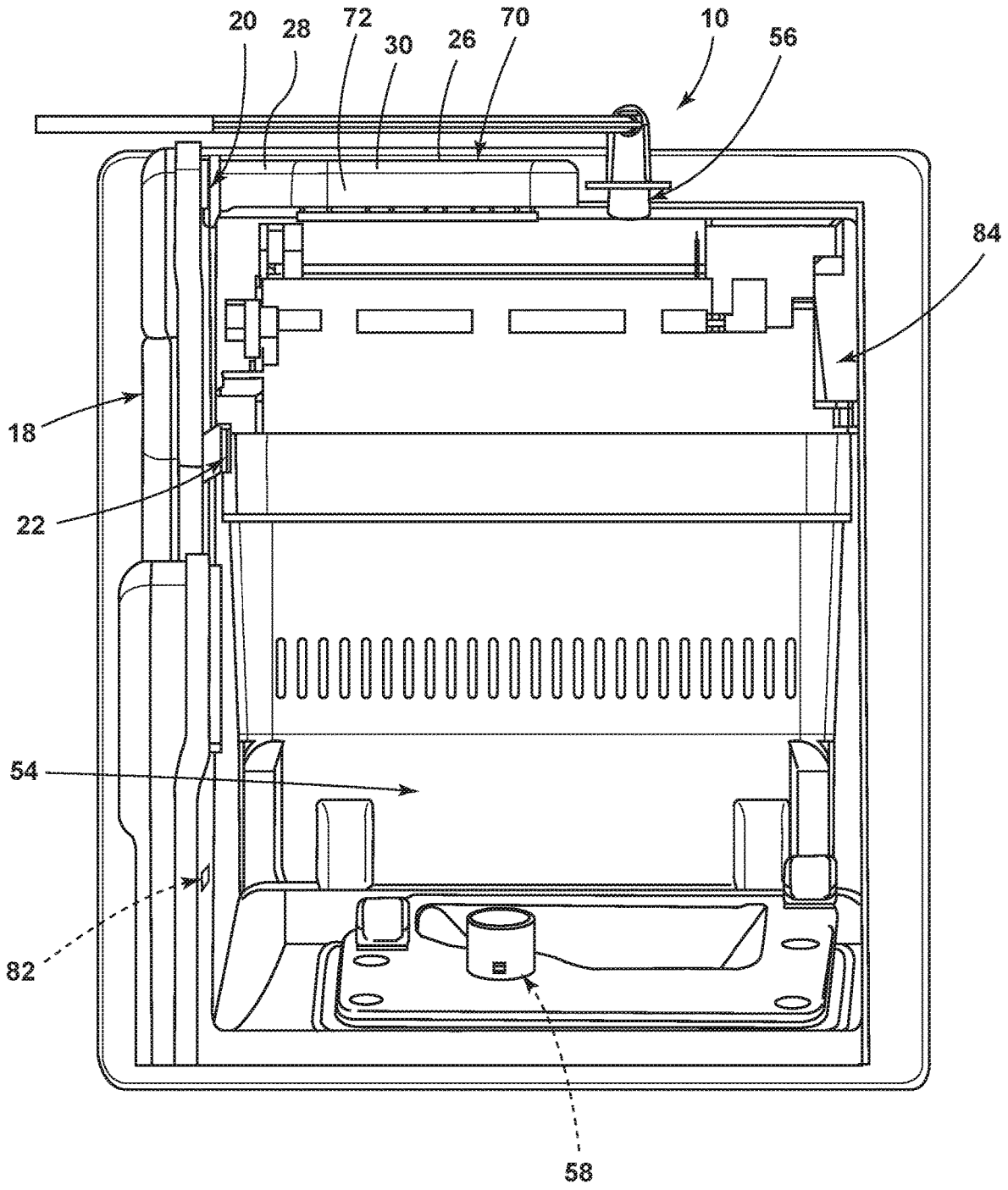
FIG. 2 is a side perspective view of an icemaker for a refrigerated appliance incorporating an upper baffle and a lower baffle, according to some examples.

Referring to FIGS. 1 and 2, reference numeral 12 generally designates the refrigerated appliance with the icemaker 10. The icemaker may be used as a stand-alone appliance or within another appliance, such as a refrigerator. The ice-making process may be induced, carried out, stopped, and the ice is harvested with little, or no, user input. FIG. 1 generally shows a refrigerator of the French-door bottom mount type, but it is understood that this disclosure could apply to any type of refrigerator, such as a side-by-side, two-door bottom mount, or a top-mount type refrigeration unit.

As shown in FIGS. 1 and 2, the refrigerated appliance 12 may have a refrigerated compartment 36 configured to refrigerate consumables and a freezer compartment 38 configured to freeze consumables during normal use. Accordingly, the refrigerated compartment 36 may be kept at a temperature above the freezing point of water and generally below a temperature of from about 35° F. to about 50° F., more typically below about 38° F. and the freezer compartment 38 may be kept at a temperature below the freezing point of water.

In some instances, the refrigerated appliance 12 has a cabinet 40 and a liner within the cabinet 40 to define the refrigerated compartment 36 and the freezer compartment 38. A mullion 42 may separate the refrigerated compartment 36 and the freezer compartment 38.

The refrigerated appliance 12 may have one or more doors 44, 46 that provide selective access to the interior volume of the refrigerated appliance 12 where consumables may be stored. As shown, the refrigerated compartment doors are designated 44, and the freezer door is designated 46. It is appreciated that the refrigerated compartment 36 may only have one door 44.

The icemaker 10 may be positioned within the door 44 and in an icemaker receiving space 48 of the appliance to allow for delivery of ice through the door 44 in a dispensing area 50 on the exterior of the appliance. The dispensing area 50 may be at a location on the exterior below the level of an ice storage bin 54 to allow gravity to force the ice down an ice dispensing chute in the refrigerated appliance door 44. The chute extends from the storage bin 54 to the dispenser area 50 and ice may be pushed into the chute using an electrically power-driven auger 58.

The refrigerated appliance 12 may also have a water inlet that is fastened to and in fluid communication with a household supply of potable water. The water inlet may be fluidly engaged with one or more of a water filter, a water reservoir, and a refrigerated appliance water supply line. The water supply line may include one or more nozzles and one or more valves. The water supply line may supply water to one or more water outlets 56. For example, a first outlet may dispense water in the dispensing area and a second outlet 56 may dispense water into the ice tray 14. The refrigerated appliance 12 may also have a control board or controller that sends electrical signals to the one or more valves when prompted by a user through a user interface 86, which may be on the front face of a door 44, that water is desired or if an ice-making cycle is to begin.

The icemaker 10 may be located at an upper portion of the icemaker receiving space 48. The ice storage bin 54 may be located below the icemaker 10 such that as ice is harvested, the icemaker 10 uses gravity to transfer the ice from the icemaker 10 to the ice storage bin 54.

Figure 3:
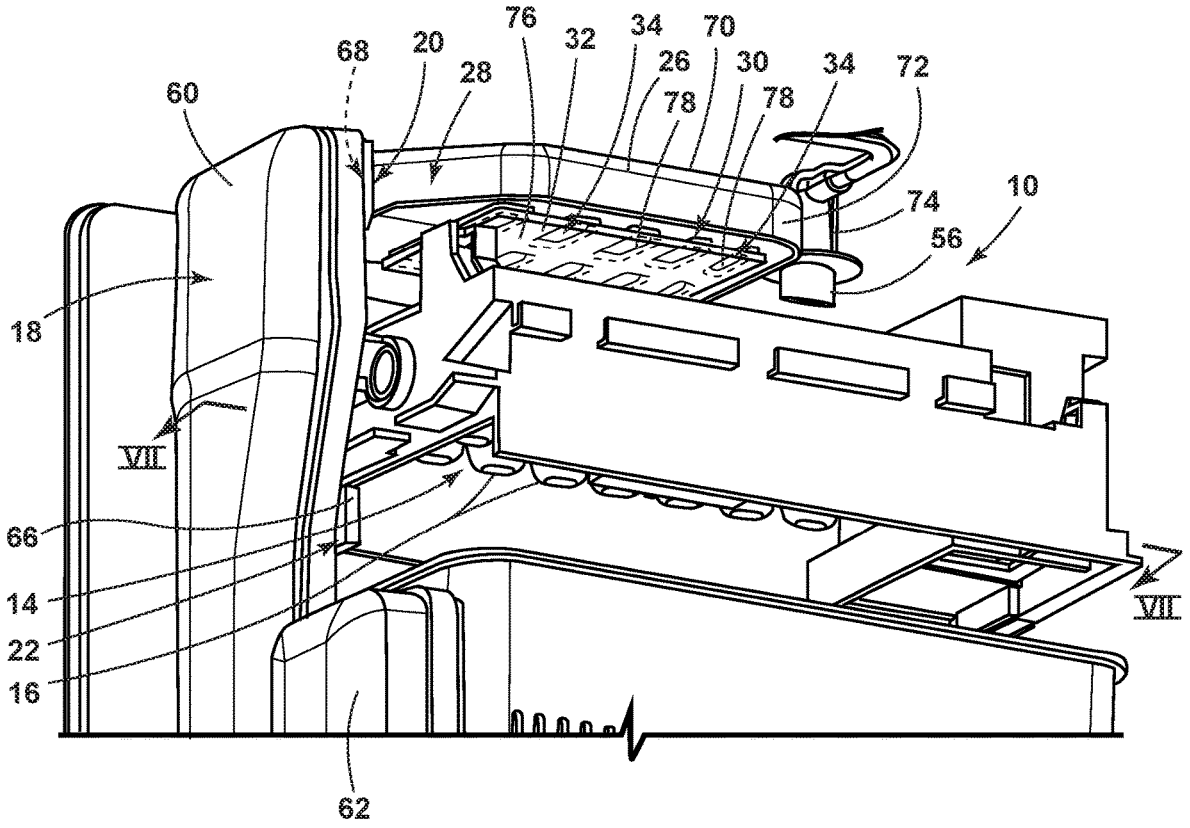
FIG. 3 is a bottom perspective view of the icemaker, according to some examples.
Figure 4:
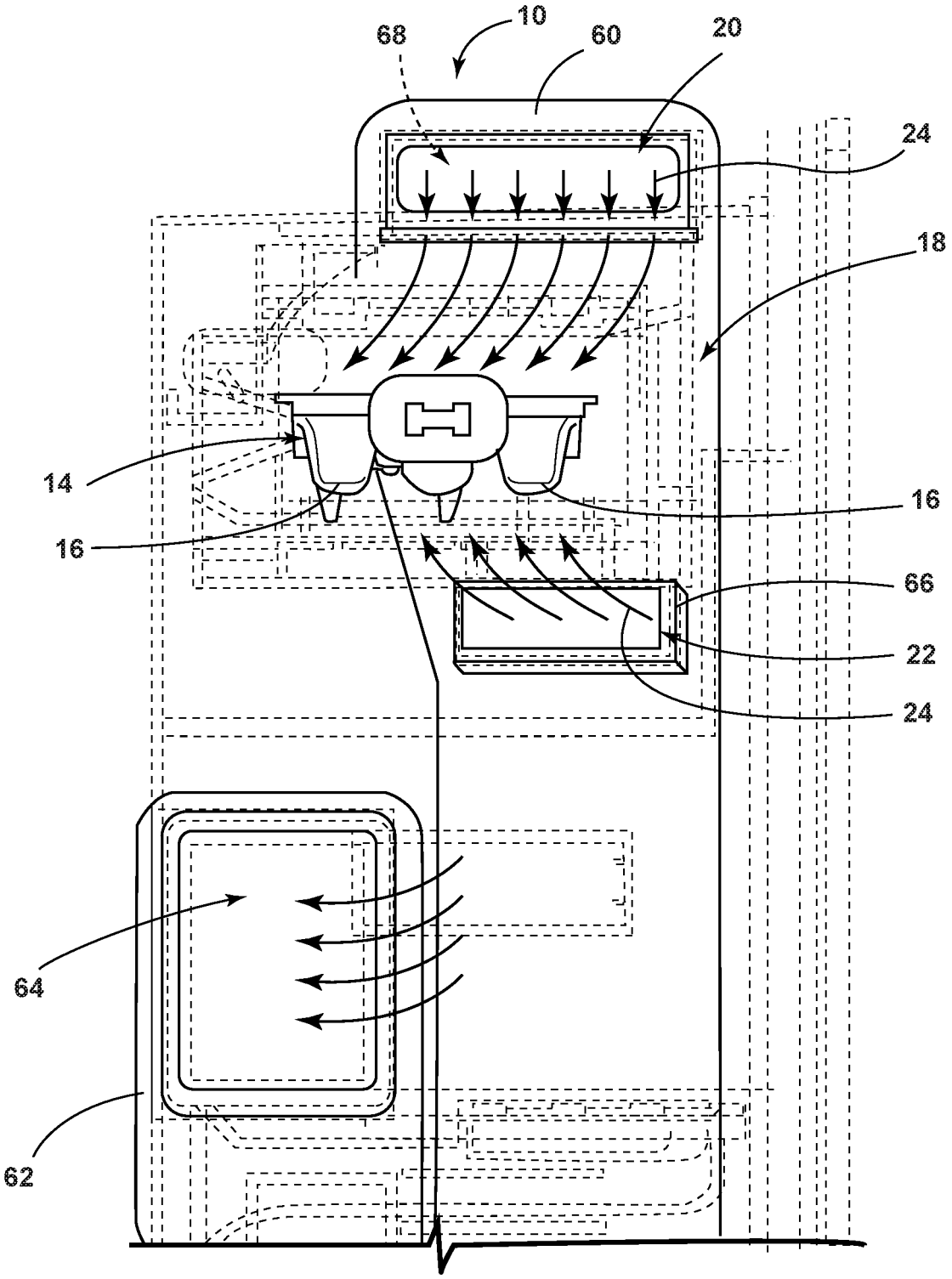
FIG. 4 is a side plan view of a duct system that supplies chilled air for the icemaker and an ice tray disposed between the upper baffle and the lower baffle, according to some examples.

As shown in FIGS. 3 and 4, the refrigerated appliance 12 may also have one or more ducts that form the duct system 18. In some examples, the duct system 18 may include a supply duct 60 and a return duct 62. The supply duct 60 may be disposed in close proximity to the ice tray 14 to direct chilled air 24 at the tray and water disposed within the tray. The return duct 62 may be disposed in close proximity to the ice bin. Accordingly, the chilled air 24 may be directed toward the ice tray 14, circulated through the ice bin, and exit through a return vent 64 defined by the return duct 62. In some examples, the return vent 64 is proximate the ice bin.

In some examples, the supply duct 60 includes the upper baffle 20 and the lower baffle 22. The upper baffle 20 is disposed above the ice tray 14 and may direct the chilled air 24 in a downward and/or horizontal direction. The lower baffle 22 may include an upwardly directed rim section 66 that is configured to direct the chilled air 24 at a bottom side of the ice tray 14. Accordingly, chilled air 24 may be directed at two opposing sides of the ice tray 14, which may decrease the amount of time needed to freeze water in the trays during the ice-making process. In some examples, the rim section 66 may be an additional component that is operably coupled to the lower baffle 22. Alternatively, the rim section 66 may be integrally formed with the lower baffle 22 and/or the supply duct 60. Moreover, in some instances, the rim section 66 is configured to direct the chilled air 24 at the bottom side of the ice tray 14 with no obstacles between the rim section 66 and the ice tray 14.

The deflector 26 is operably coupled with the upper baffle 20 and is configured to redirect air from the upper baffle 20 towards various portions of the ice tray 14. Accordingly, the deflector 26 includes an entry portion 68 that is proximate the upper baffle 20. The deflector 26 further includes a top surface 70 and a peripheral portion 72 extending therefrom. As the chilled air 24 is directed outwardly from the upper baffle 20, the chilled air 24 is substantially maintained below the deflector 26. Moreover, the deflector 26 is configured to direct the chilled air 24 downwardly and towards the ice tray 14.

In some examples, the deflector 26 may be disposed over a portion of the ice tray 14. Or, in other words, the second water supply outlet 56 is disposed over the ice tray 14 on an opposing side of the deflector 26 from the upper baffle 20. A heater 74 is installed on the second water supply outlet 56. The heater 74 heats the outlet to prevent blockages thereof. The heater 74 may include an electric heating medium that generates heat upon receiving electric power or the like. The heater 74 heats the bottom portion of the outlet 56 before the water supply is operated so that the water can be easily disposed within the ice tray 14.

Figure 5A:
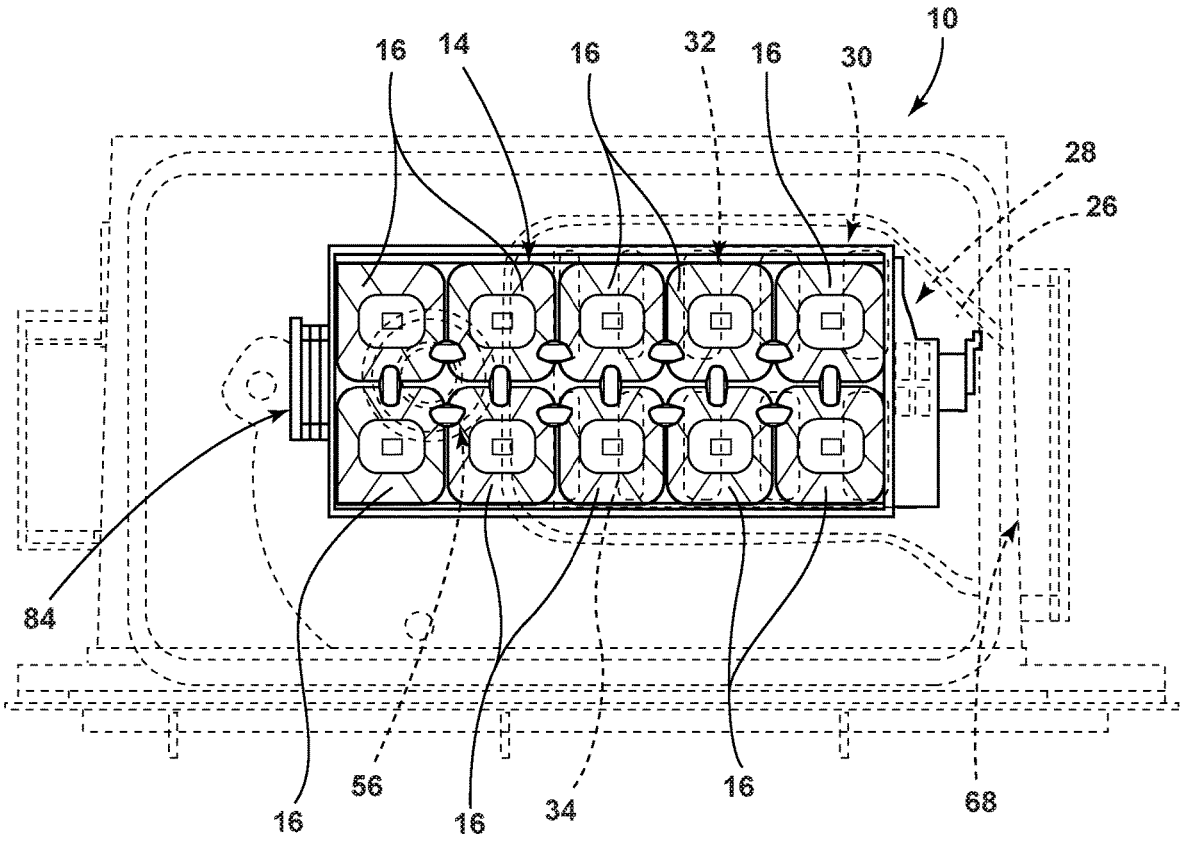
FIG. 5A is a top plan view of the ice tray, according to some examples.
Figure 5B:
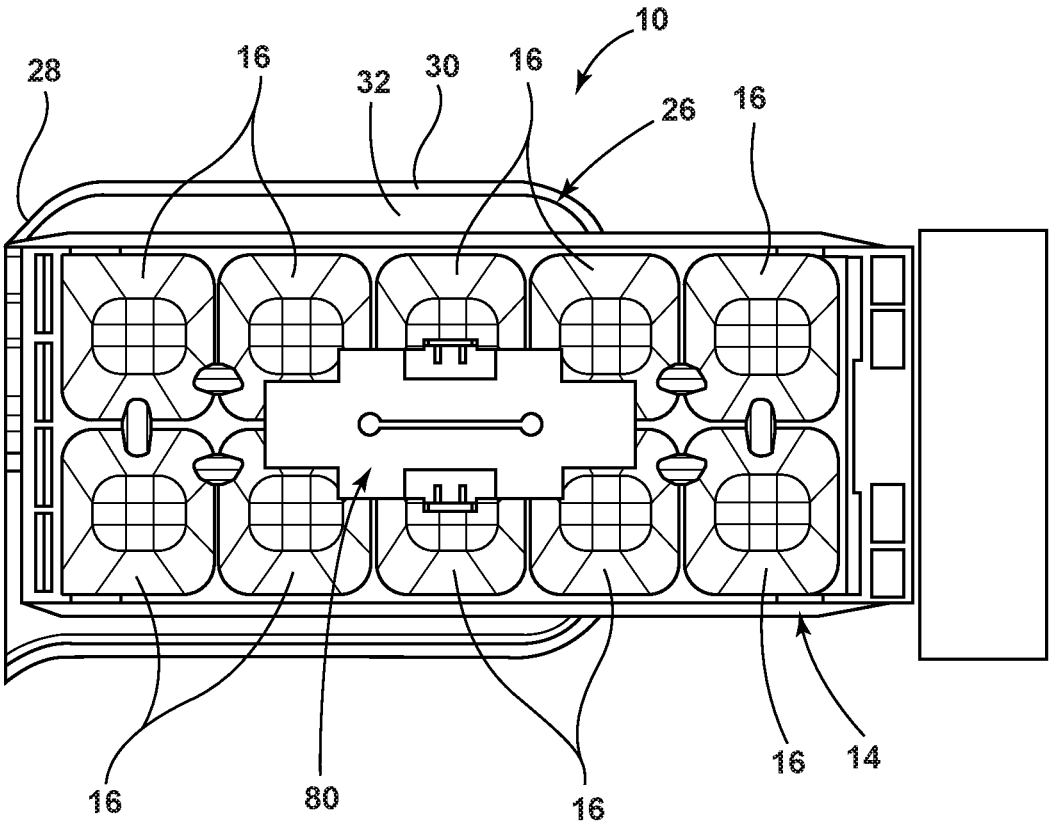
FIG. 5B is a bottom plan view of the ice tray, according to some examples.
Figure 6:
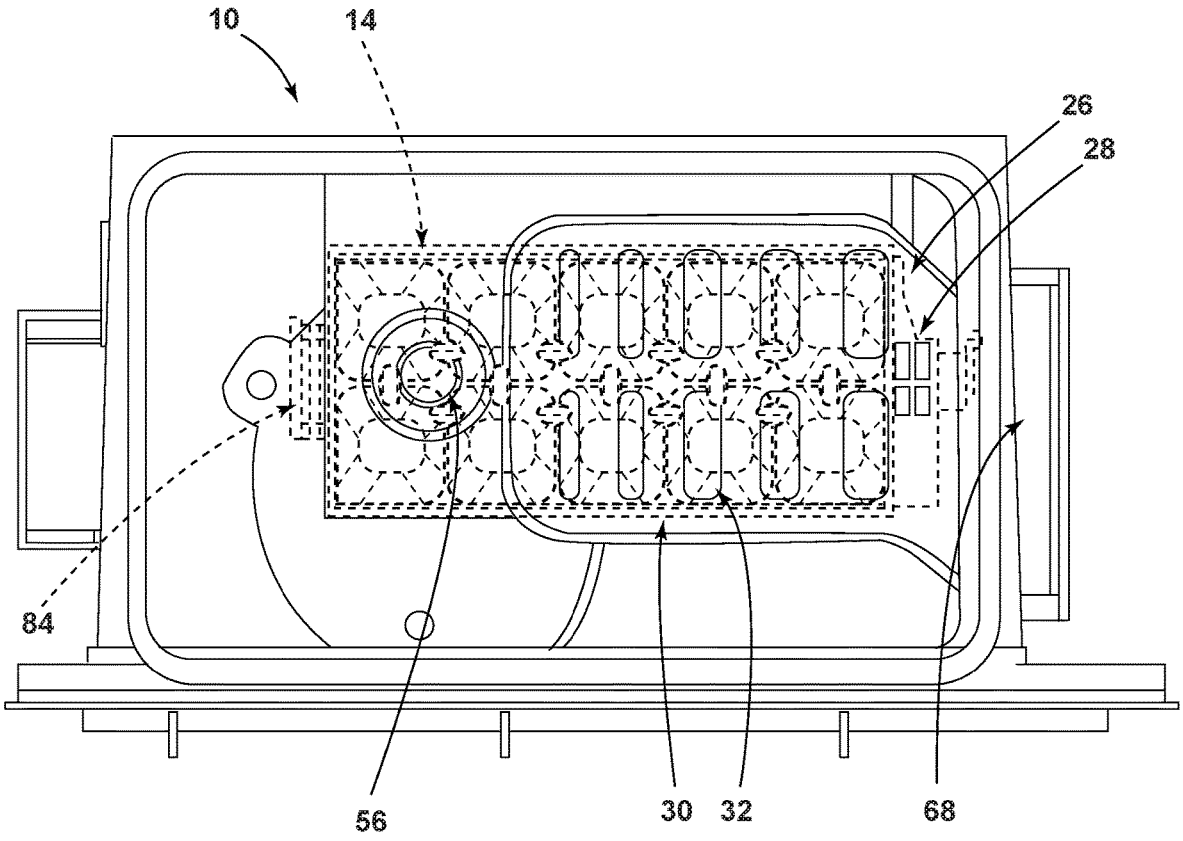
FIG. 6 is a top plan view of the deflector, according to some examples.
Figure 7:
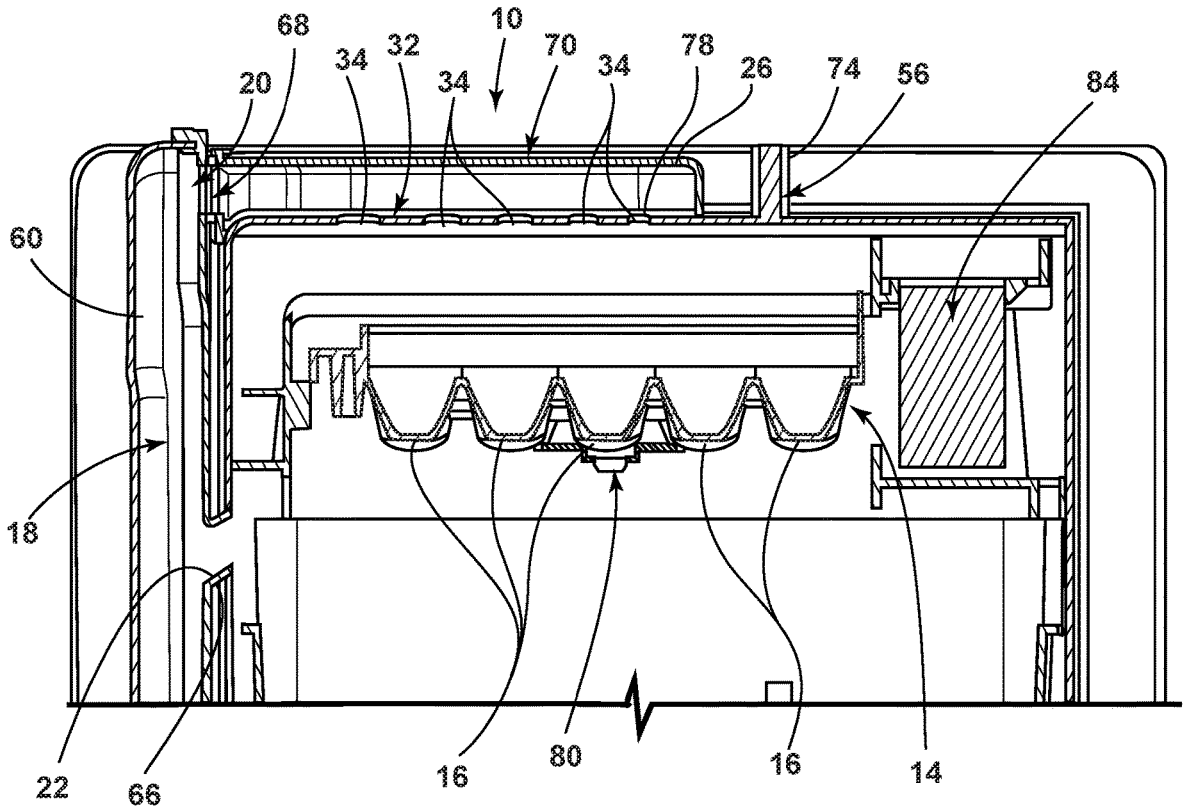
FIG. 7 is a cross-sectional view taken along the line VII-VII of FIG. 3 illustrating the icemaker according to some examples.
Figure 8:
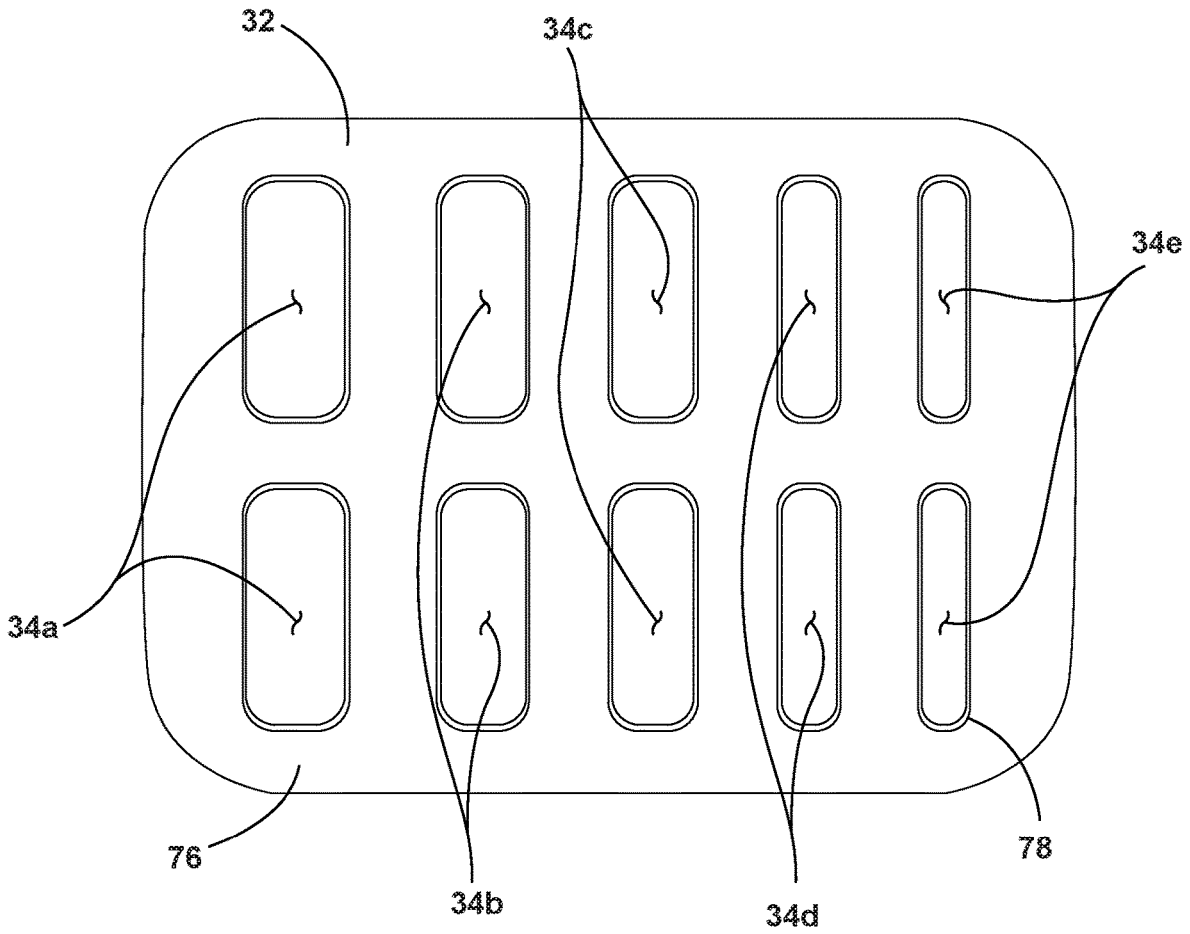
FIG. 8 is a top plan view of the diverter defining variously sized slots therealong, according to some examples.

Referring to FIGS. 5A-6, the upper and lower baffles 20, 22 may be offset from the ice tray 14. Accordingly, the deflector 26 may have a transition portion 28 that directs air from the upper baffle 20 to the body portion 30 over the ice tray 14. The body portion 30 may be operably coupled with an air diverter 32 that directs the chilled air 24 within the body portion 30 through predefined slots 34 within the diverter 32.

Referring to FIGS. 3-7, the diverter 32 may include a base 76 that defines the plurality of slots 34. A border 78 may surround each of the plurality of slots 34. In some instances, the border 78 extends upwardly from the base 76 and encompasses each respective slot. Each slot defines an opening area through which the chilled air 24 is directed. In some examples, a first pair of slots 34*a* (FIG. 8) closest to the upper baffle 20 has a first opening area. An adjacently disposed second pair of slots 34*b* on an opposing side of the first pair of slots 34*a* from the upper baffle 20 has a second opening area that is smaller than the first opening area. Likewise, a third pair of slots 34*c* is disposed on opposing side of the second pair of slots 34*b* from the first pair of slots 34*a* and has a third opening area that is less than the second opening area. A fourth pair of slots 34*d* defines a fourth opening area and has a smaller opening area than the third area. Lastly, a fifth pair of slots 34*e* defines a fifth opening area that is less than the fourth area. It will be appreciated, however, that any of the slots 34*a*, 34*b*, 34*c*, 34*d*, 34*e* may have an opening area that is equal to any number, or all, of the remaining slots. Moreover, the slots 34*a*, 34*b*, 34*c*, 34*d*, 34*e* may be varied in any other pattern without departing from the scope of the present disclosure. Furthermore, in some instances, any and/or all of the slots 34*a*, 34*b*, 34*c*, 34*d*, 34*e* disposed on the diverter 32 may be of an equal size to one another without departing from the scope of the present disclosure.

In some instances, the fifth pair of slots 34*e* has a smaller opening area such that the chilled air 24 is directed therethrough at a higher pressure and/or velocity than the first pair of slots 34*a*. For example, the airflow velocity can be calculated by the following formula: air velocity=air flow/area of the duct. Accordingly, as the size of the slot is decreased, the airflow velocity is increased. The airflow may be increased to reach portions of the tray that extend beyond the diverter 32. Additionally, and/or alternatively, the airflow may be increased to decrease the amount of time before the chilled air 24 reaches the ice tray 14 to increase the efficiency of the water freezing process.

As illustrated in FIGS. 5A-6, the air diverter 32 may be disposed over a portion of the ice tray 14. However, it will be appreciated that in other examples the diverter 32 may be disposed over the whole ice tray 14 without departing from the teachings provided herein. As illustrated, the ice tray 14 includes five longitudinally aligned compartments 16 in which ice may be formed and the diverter 32 extends over four of the five longitudinally aligned compartments 16. As the chilled air 24 is directed from the upper baffle 20 and through the deflector 26 and the slots 34 in the diverter 32, the chilled air 24 is forced away from the duct system 18 causing a first end portion of the ice tray 14 that is proximate the duct system 18 and a second end portion of the ice tray 14 on an opposing side of the ice tray 14 to be contacted by the chilled air 24.

In some examples, the ice tray 14 may incorporate a temperature sensor 80, for example, a thermistor or other temperature-sensing element positioned beneath the ice tray 14 in close proximity to the compartments 16 so as to sense a temperature of that volume. Temperatures at or above the freezing point generally indicate incomplete freezing of the cubes, whereas temperatures below freezing indicate that the cube has frozen and no additional phase change is occurring. As provided herein, the first end portion of the ice tray 14 may be proximate the duct system 18 while the second end portion of the ice tray 14 may be disposed further from the duct system 18. The temperature sensor 80 may be disposed outwardly of a portion of the ice tray 14 that is directly contacted by the chilled air as a temperature of the non-directly contacted portions of the ice tray. It will be appreciated, however, that the temperature sensor may be disposed in any practicable location without departing from the scope of the present disclosure.

In operation, the icemaker 10 may begin an ice-making cycle when a controller in electrical communication with an ice level sensor 82 (FIG. 2), ice level input measuring system and/or device detects an actual ice level is below a predetermined ice level. To begin the ice-making process, the icemaker 10 checks whether the ice tray 14 is in the home position, such as an upright or horizontal position. If the ice tray 14 is not in its home position, the controller may send a signal to a motor 84 to rotate the ice tray 14 back to its home position. Once the ice tray 14 is determined to be in its home position, the controller determines whether any previous harvests were completed. If the previous harvest was completed, the controller may send an electrical signal to open a valve in fluid communication with the icemaker 10. Either after a predetermined amount of valve open time or when the controller senses that a predetermined amount of water has been delivered to the ice tray 14, a signal will be sent by the controller to the valve to close the valve. The predetermined amount of water may be based on the size of the ice tray 14 and/or the speed at which a user would like ice and may be set at the point of manufacture or based on an input from a user into a user interface 86 (FIG. 1). The water outlet 56 may be positioned above the ice tray 14, such that the water falls with the force of gravity into the ice tray 14.

After the ice tray 14 is filled, or if the controller determines that the previous harvest was incomplete, the freeze timer may be started, and the chilled air 24 at a temperature below the freezing point of water is forced through the supply duct 60 of the duct system 18 of the icemaker. The air may be forced by one or more fan or any other method of moving air known in the art. As provided herein, the duct system 18 includes an upper baffle 20 that directs air from the duct system 18 above the ice tray 14 and a lower baffle 22 that directs air at a bottom side of the ice tray 14.

During the freezing process, the controller may determine if a refrigerated appliance door 44 has been opened. If the door 44 is determined to be open at any time, the freeze timer is paused until the door 44 is closed. After some time, substantially all or all of the water will be frozen into ice.

The controller may detect this by using the thermistor or another sensor. During the freezing process, the controller also may determine if the temperature of the ice tray 14 or the temperature within the ice compartment 16 is above a certain temperature for a certain amount of time. This temperature may be between 20° F. and 30° F., and more typically from about 22° F. to about 28° F. If the controller determines that the temperature was above the specified temperature for longer than the specified time, the freeze timer may reset.

When the freeze timer reaches a predetermined time and/or when the thermistor sends an electrical signal to the controller that a predetermined temperature of the ice tray 14 is met, the controller may read this as the water is frozen, and it may begin the harvesting process. Consequently, the controller will send a signal to the motor 84 to begin rotating. As the motor 84 begins rotating, the ice tray 14, which is rotationally engaged with the motor 84 at the second end portion, rotates with it. The ice tray 14 may begin at a substantially horizontal position. The motor 84 rotates the ice tray 14 to a predetermined angle. When the motor 84 and tray reach the predetermined angle, the first end portion of the ice tray 14 may be prevented from rotating any further by a bracket stop. With the first end portion held in place by the bracket stop, the motor 84 continues to rotate the ice tray 14 to a second predetermined angle. By continuing to rotate the second end portion, a twist is induced in the ice tray 14. The twist in the ice tray 14 induces an internal stress between the ice and the ice tray 14, which separates the ice from the ice tray 14. The twist angle may be any angle sufficient to break the ice loose from the ice tray 14. After the rotation is complete, the motor 84 returns to its home position. If the controller determines that the ice tray 14 reached the harvest position and back to home position, the cycle may begin again.

Figure 9:
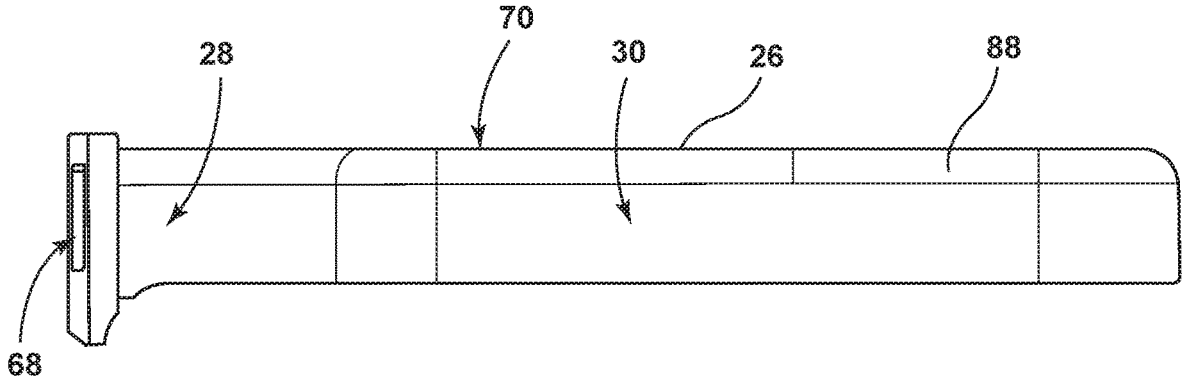
FIG. 9 is a side plan view of the deflector according to some examples.
Figure 10:
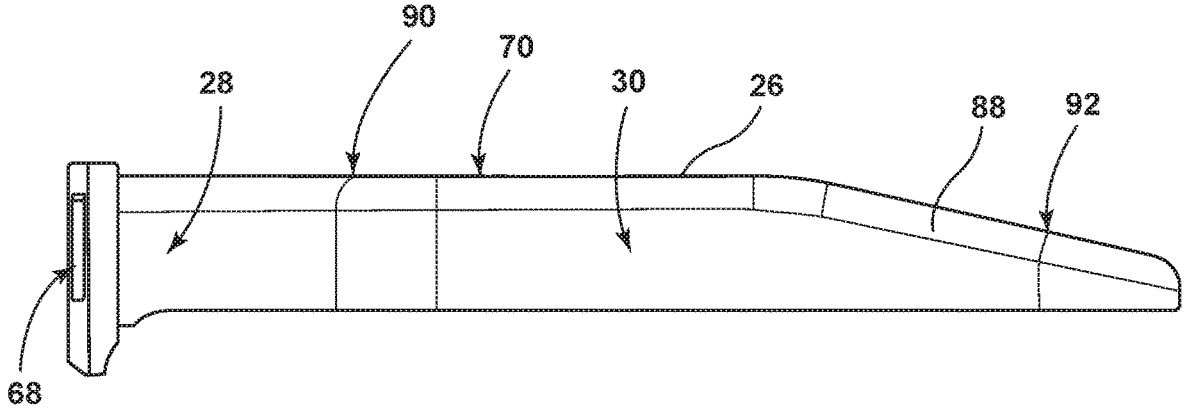
FIG. 10 is a side plan view of the deflector according to some examples.

Referring to FIGS. 9 and 10, as provided herein, the deflector 26 includes the body portion 30 and the transition portion 28. In some examples, the deflector 26 may be integrally formed with a portion of the duct system 18. The body portion 30 is disposed over the ice tray 14 while the transition portion 28 may be offset from the body portion 30 and configured to couple to the duct system 18 around the upper baffle 20. The entry portion 68 of the deflector 26 may surround the upper baffle 20. In other examples, the entry portion 68 may partially surround or otherwise be operably coupled with the upper baffle 20.

With further reference to FIGS. 9 and 10, the body portion 30 of the deflector 26 may be of any practicable geometry without departing from the scope of the present disclosure. For example, as illustrated in FIG. 9, the body portion 30 of the deflector 26 may have a linear top surface 70. A radiused portion 88 may couple the body portion 30 to the peripheral portion 72. Alternatively, as illustrated in FIG. 10, the top surface 70 of the body portion 30 may have a first linear section 90 and a second section 92 that is angled downwardly from the first section 90. Like the example illustrated in FIG. 9, the radiused portion 88 couples the top surface 70 to the peripheral portion 72.

Figure 11:
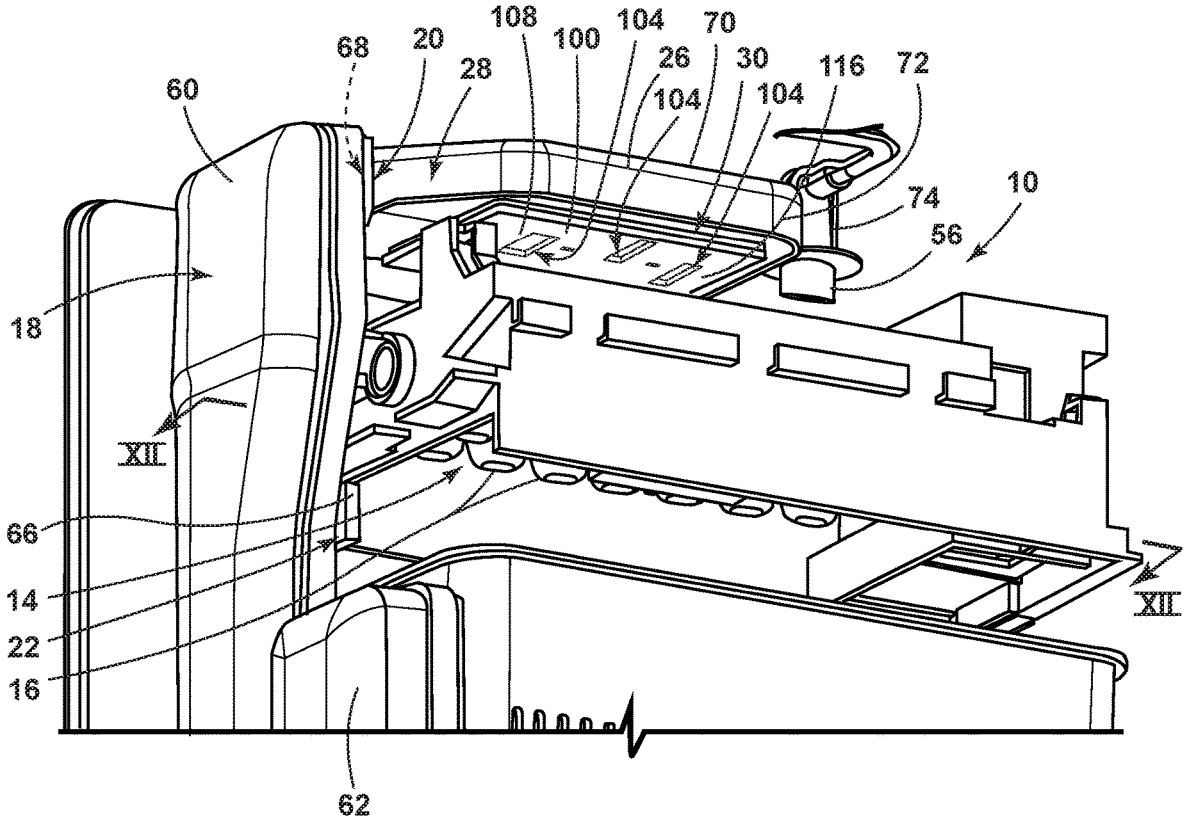
FIG. 11 is a bottom perspective view of an icemaker, according to some examples.
Figure 12:
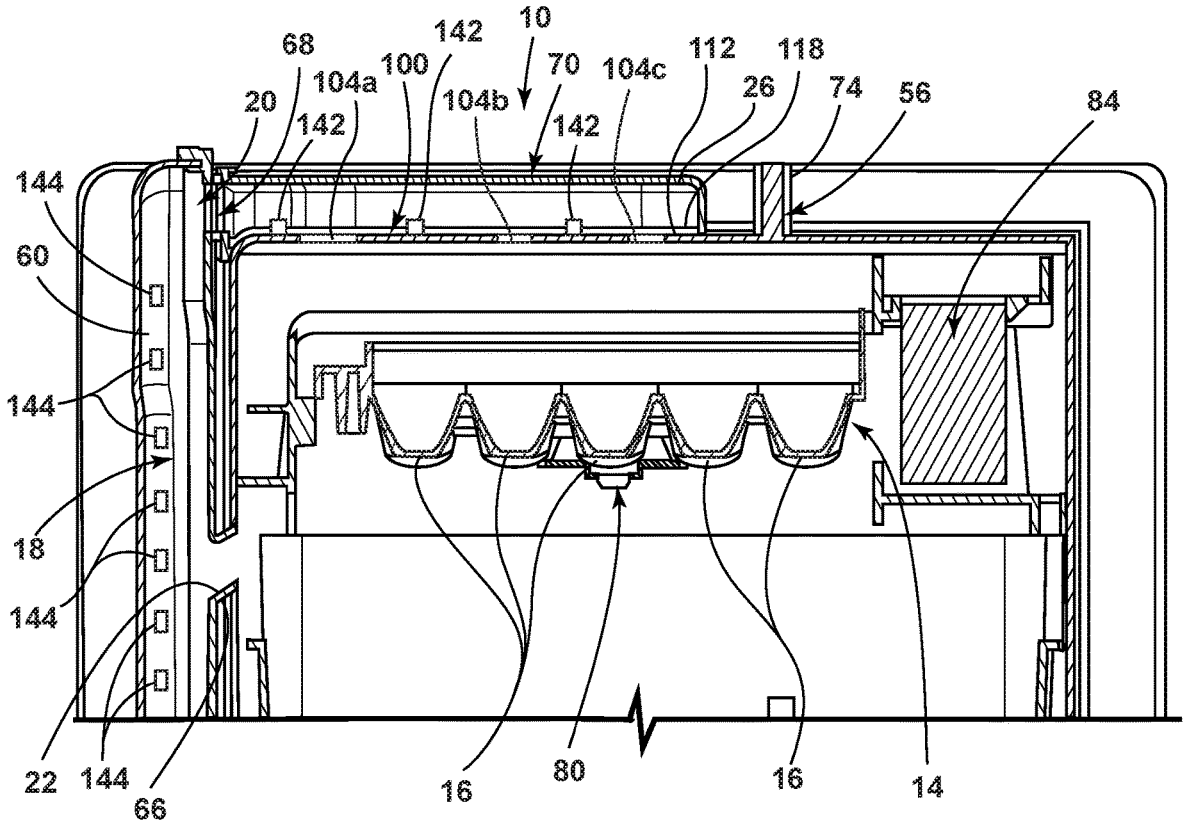
FIG. 12 is a cross-sectional view taken along the line XII-XII of FIG. 11 illustrating the icemaker according to some examples.
Figure 13:
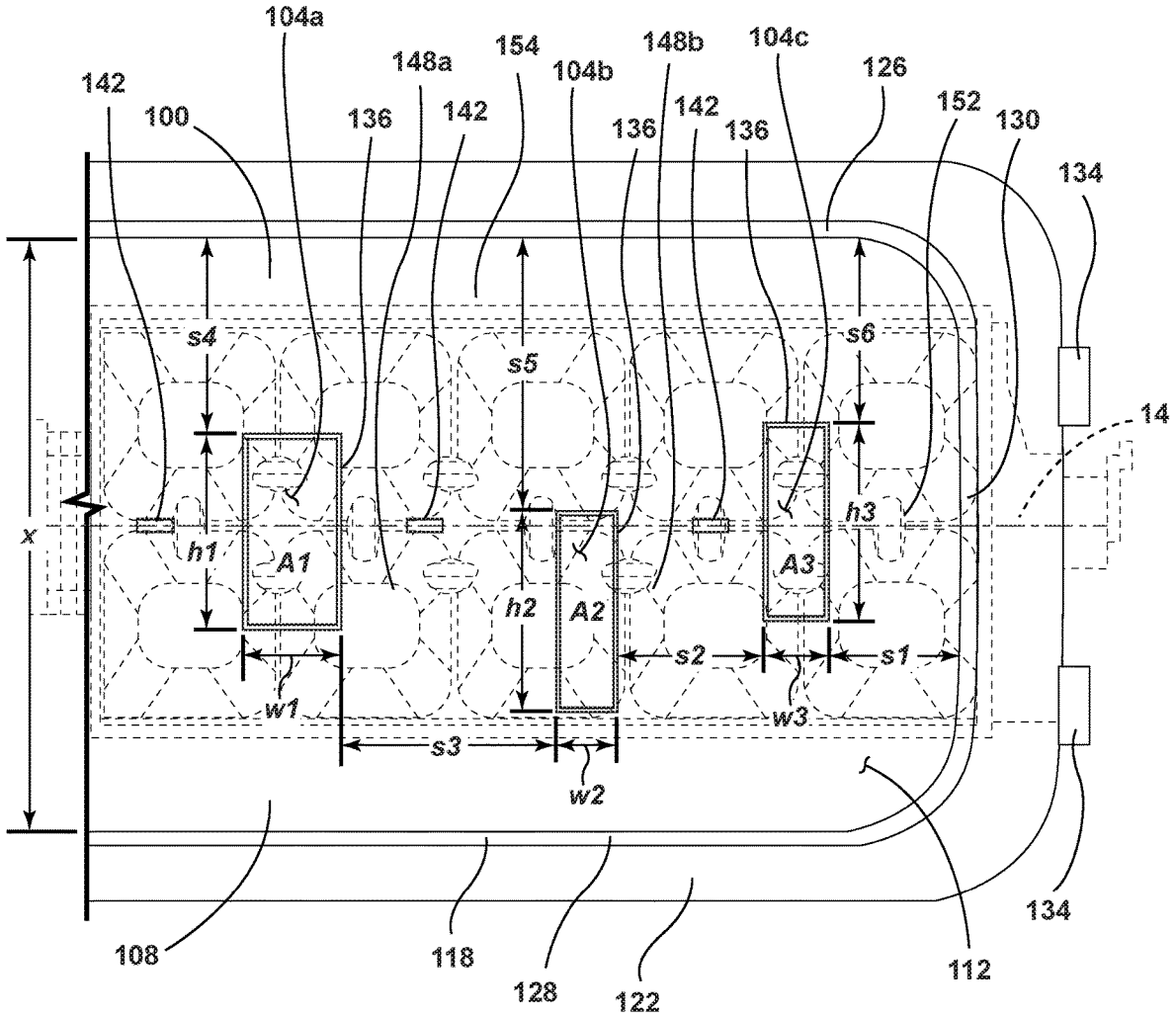
FIG. 13 is a top plan view of a diverter defining variously sized slots therealong with an ice tray shown in phantom, according to some examples.

Referring to FIGS. 11-13, the body portion 30 of the deflector 26 may be operably coupled with an air diverter 100 that directs the chilled air 24 within the body portion 30 through a plurality of predefined slots 104 within the diverter 100. The diverter 100 may include a base 108 that defines the plurality of slots 104. The base 108 may include an upper surface 112 and a lower surface 116, where the upper surface 112 may be proximate the body portion 30 of the deflector 26 and the lower surface 116 may be proximate the ice tray 14. The base 108 defines each of the plurality of slots 104. In some examples, a border 136 may surround each of the plurality of slots 34. The border 136 may extend upwardly from the base 108 and encompass each respective slot. In other examples, the border 136 may be flush with the upper surface 112 of the base 108. Each slot 104 has an opening area through which the chilled air 24 is directed.

A rim 118 may surround a portion of the diverter 100 and define a channel 122 configured to at least partially receive the body portion 30 of the deflector 26. The rim 118 may include first and second sidewalls 126, 128 extending parallel to the body 30 of the deflector 26 and the ice tray 14. The first and second sidewalls 126, 128 are spaced apart a predetermined distance x. The predetermined distance may vary from about 90 mm to about 96 mm. For example, the predetermined distance may be about 93 mm. A third wall 130 may connect the first and second sidewalls 126, 128. The body 30 of the deflector 26 may snap into engagement with clips 134 positioned proximate the channel 122.

A plurality of fins 142 extend from the upper surface 112 of the diverter 100. The fins 142 may be spaced along the upper surface 112 and extend at least partially upward to the deflector 26. In other words, the fins 142 extend from the base 108 in a direction opposite of the ice tray 14. Each of the fins 142 may be generally rectangular in shape, according to various examples. According to other examples, the fins 142 may be oblong, triangular, or any other higher level polygon. The fins 142 may be positioned to direct the chilled air 24 as it flows through the body portion 30 of the deflector 24.

As shown in FIG. 12, a second plurality of fins 144 may be positioned within the duct system. The fins 144 may be generally rectangular, according to various examples. The fins 144 may be spaced along an inner surface 146 of the ducts to direct the chilled air 24 as it flows to the upper and lower baffles 20, 22.

Referring again to FIGS. 11-13, the plurality of slots 104 may include a first slot 104*a*, a second slot 104*b*, and a third slot 104*c*. According to various examples, the first slot 104*a* is closest to the upper baffle 20 and has a first opening area A1. The second slot 104*b* is adjacently disposed on an opposing side of the first slot 104*a* from the upper baffle 20 has a second opening area A2 that is smaller than the first opening area A1. Likewise, the third slot 104*c* is disposed on an opposing side of the second slot 104*b* from the first slot 104*a* and has a third opening area A3 that is greater than the second opening area A2 and less than the first opening area A1. It will be appreciated, however, that any of the slots 104*a*, 104*b*, 104*c* may have an opening area that is equal to any number, or all, of the remaining slots. Moreover, the slots 104*a*, 104*b*, 104*c* may be varied in any other pattern without departing from the scope of the present disclosure. Furthermore, in some instances, any and/or all of the slots 104*a*, 104*b*, 104*c* disposed on the diverter 100 may be of an equal size to one another without departing from the scope of the present disclosure.

As shown in FIG. 13, the slots 104*a*, 104*b*, 104*c* may be offset from a central axis of the ice tray 14. The diverter 100 may be spaced apart from a top surface of the ice tray 14. The diverter 100 may be positioned above and parallel to the top surface of the ice tray 14. According to various examples, a centerline of the diverter 100 may be aligned with a central axis of the ice tray 14. According to other examples, the centerline of the diverter 100 may be adjusted while the plurality of slots 104 remains offset from the central axis of the ice tray 14, and the first and second side walls 126, 128 of the rim 118 of the diverter 100 may remain equally spaced from the central axis of the ice tray 14. The first slot 104*a* and the second slot 104*b* may be spaced apart by a first spacing portion 148*a*. Similarly, the third slot 104*c* may be spaced apart from the second slot 104*b* by a second spacing portion 148*b*. The first spacing portion 148*a* has a first length s1 of about 30 mm to about 36 mm. For example, the first length s1 may be about 33 mm. Similarly, the second spacing portion 148*b* may have a second length s2 of about 20 mm to about 26 mm. For example, the second length s2 may be about 23 mm.

The third slot 104*c* may further be spaced apart from the third wall 130 of the rim 118 by a first edge portion 152 of the base 108 having a third length s3. The third length s3 may be about 3 mm to about 9 mm. For example, the third length s3 may be about 6 mm. Likewise, the first slot 104*a*, the second slot 104*b*, and the third slot 104*c* may be spaced apart from the first sidewall 126 by a second edge portion 154 of the base 108 having varying lengths along the base 108. For example, second edge portion 154 may have a fourth length s4 between the first sidewall 126 and the first slot 104*a*, a fifth length s5 between the first sidewall 126 and the second slot 104*b*, and a sixth length s6 between the first sidewall 126 and the third slot 104*c*. The fourth length s4 may be about 33 mm to about 39 mm. Similarly, the fifth length s5 may be about 45 mm to about 51 mm, and the sixth length s6 may be about 32 mm to about 38 mm. In various examples, the fourth length s4 may be about 36 mm, the fifth length s5 may be about 48 mm, and the sixth length s6 may be about 34 mm. It will be appreciated, however, that any of the lengths s1, s2, s3, s4, s5, s6 may have any value that is equal to any number or range of numbers within the specified ranges, without departing from the scope of the present disclosure.

Each slot 104*a*, 104*b*, 104*c* defines the respective opening area A of a different size. Each opening area A includes a height h and width w. The heights h of the slots 104 may vary. For example, the height h1 of the first slot 104*a* may be about 25 mm to about 31 mm, and the width w1 of the first slot 104*a* may be about 10 mm to about 16 mm. For example, the height h1 and the width w1 of the first slot 104*a* may be about 28 mm and about 13 mm, respectively. Similarly, the height h2 of the second slot 104*b* may be about 26 mm to about 32 mm, and the width w2 of the second slot 104*b* may be about 5 mm to about 11 mm. For example, the height h2 and the width w2 of the second slot 104*b* may be about 29 mm and about 8 mm, respectively. Further, the height h3 of the third slot 104*c* may be about 26 mm to about 32 mm, and the width w3 of the third slot 104*c* may be about 5 mm to about 11 mm. For example, the height h3 and the width w3 of the third slot 104*c* may be about 28 mm and about 8 mm, respectively. It will be understood that any of the heights h1, h2, h3 and the widths w1, w2, w3 may have any value that is equal to any number or range of numbers within the specified ranges, without departing from the scope of the present disclosure.

Where the opening area A of the slots 104*a*, 104*b*, 104*c* decreases, the chilled air 24 is directed therethrough at a higher pressure and/or velocity than the larger opening areas. For example, the airflow velocity can be calculated by the following formula: air velocity=air flow/area of the duct. Accordingly, as the size of the slot is decreased, the airflow velocity is increased. The airflow may be increased to reach specific portions of the tray 14. Additionally, and/or alternatively, the airflow may be increased to decrease the amount of time before the chilled air 24 reaches the ice tray 14 to increase the efficiency of the water freezing process.

Figure 14:
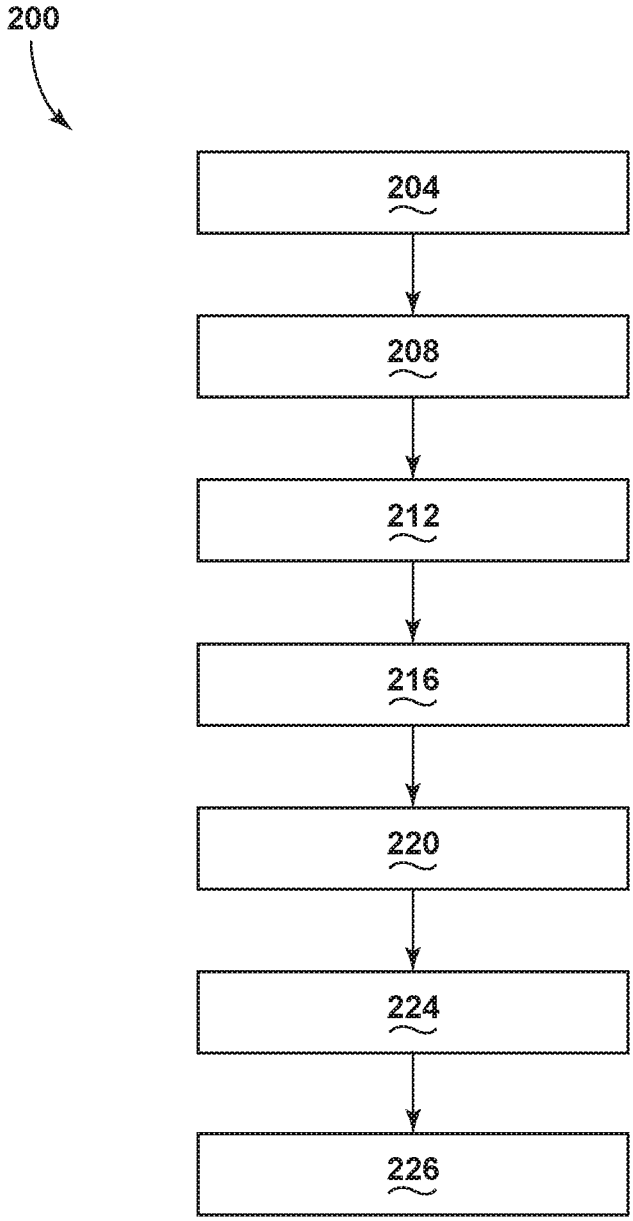
FIG. 14 is a flow diagram for a method for forming ice.

Referring now to FIG. 14, a method 200 for forming ice in the ice tray 14 may be provided. The method 200 includes a step 204 of generating chilled air for freezing water within the ice tray 14. According to various examples, the air 24 may be chilled to about −15.5° F. or about −9.0° F. In other examples, the air 24 may be chilled to a temperature of about −25° F. to about 0° F. or any value or range of values therebetween.

The method 200 also includes a step 208 of coupling the duct system 18 having the plurality of fins 144 with the diverter 32, 100. Another step 212 of the method 200 may include positioning the diverter 32, 100 over the ice tray 14 having the plurality of ice forming compartments 16. The method 200 may further include a step 216 of filling the plurality of ice forming 16 compartments with water. Another step 220 of the method 200 includes forcing the chilled air 24 through the duct system 18, over the plurality of fins 144, and through the diverter 32, 100 such that the chilled air 24 is unevenly distributed through the diverter 32 in a predetermined pattern. The method 200 may further include providing the icemaker 10 including the ice tray 14 with the plurality of ice forming compartments 16 and the diverter 32, 100 defining the plurality of slots 34, 104.

The step 220 may further include forcing the chilled air 24 through the duct system 18 and through the plurality of slots 34, 104 of the diverter 32, 100 such that the water freezes within 65 minutes. The method 200 may further include a step 224 of chilling the air 24 to about −15.5° F. and providing the chilled air 24 at a flow rate of about 5.5 cubic feet per minute. In some examples, the air 24 may be chilled to about −9.0° F. When the chilled air 24 is −15.5° F., ice may take about 64 minutes to form. When the chilled air 24 is −9.0° F., ice may take about 72 minutes to form. Each drop in temperature by about 1° F. may be estimated to result in about a 1 minute decrease in ice formation time. However, it will be understood that the relationship between the temperature drop and the decrease in ice formation time may vary without departing from the scope of the present disclosure.

Another step 226 may include positioning the diverter 32, 100 over the ice tray 14 such that each of the plurality of slots 34, 104 is offset from the central axis of the ice tray 14. It is contemplated, although the steps are listed in a particular order, they may be performed in any order or with two or more steps being performed concurrently without departing from the scope of the present disclosure.

A variety of advantages may be derived from the use of the present disclosure. For example, use of the icemaker provided herein may decrease the freezing time for making ice within a refrigerated appliance. Specifically, when the plurality of slots is offset, the freezing time may be reduced to a time of about 64 minutes to about 72 minutes. The use of the deflector provided herein may assist in directing chilled air 24 towards the ice tray 14 to further assist in the ice-making process. Furthermore, a diverter may be used in conjunction with the deflector for directing air in desired locations at various pressures based on the slot sizing disposed within the diverter. The ice-making assembly provided herein may be more efficient and/or cheaper to manufacture than ice-making systems currently available.

According to one aspect, an icemaker for a refrigerated appliance may be provided that includes an ice tray having a top surface and a plurality of ice-forming compartments arranged along a central axis. A duct for directing chilled air may be operably coupled with a diverter. The diverter may include a base spaced away from the top surface of the ice tray and having first and second sides. The base may define a plurality of variously sized slots. The slots may be offset from a central axis of the ice tray. At least one spacing portion may extend between two of the plurality of variously sized slots. A plurality of fins may extend away from a top surface of the base.

According to another aspect, each of the plurality of variously sized slots may be offset from a centerline of the diverter, the centerline of the diverter aligned with the central axis of the ice tray.

According to other aspects, the plurality of variously sized slots may include a first slot, a second slot, and a third slot.

According to yet another aspect, the first slot may have a first area and the second slot may have a second area. The second area may be less than the first area. The second slot may be disposed on an opposing side of the first slot from the duct.

According to still other aspects, the third slot may have a third area less than the first area and greater than the second area. The third slot may be positioned on an opposing side of the second slot from the first slot.

According to another aspect, the at least one spacing portion may include a first spacing portion extending between the first slot and the second slot and a second spacing portion extending between the second slot and the third slot.

According to yet another aspect, the first spacing portion may have a length of about 20 mm to about 25 mm.

According to other aspects, the second spacing portion may have a length of about 30 mm to about 35 mm.

According to still other aspects, an icemaker for a refrigerated appliance may be provided that includes an ice tray having a top surface and a plurality of ice-forming compartments arranged along a central axis. A duct system may have upper and lower baffles. The upper baffle may direct chilled air above the ice tray. A diverter may be positioned parallel above and spaced apart from the ice tray and defining a plurality of slots therein. The plurality of slots may be offset from a central axis of the ice tray.

According to another aspect, the plurality of slots may include a first slot, a second slot, and a third slot. Each of the plurality of slots may have one of a first area, a second area, and third area, respectively.

According to yet another aspect, each of the first area, the second area, and the third area may be different.

According to other aspects, a fin may extend from the base in a direction opposite of the ice tray.

According to still other aspects, the fin may affect the flow of the chilled air through the plurality of slots.

According to yet another aspect, chilled air from the duct system may be directed through the plurality of slots to the ice tray.

According to other aspects, the diverter may include at least one spacing portion.

According to another aspect, the at least one spacing portion may include a first spacing portion extending between the first slot and the second slot and having a first length and a second spacing portion extending between the second slot and the third slot and having a second length.

According to yet another aspect, the first length may be less than the second length.

According to still other aspects, a method for forming ice may be provided including a step of generating chilled air. Another step may include coupling a duct system having a plurality of fins with a diverter. Yet another step may include positioning the diverter over an ice tray having a plurality of ice forming compartments. The method may include another step of filling the plurality of ice forming compartments with water. Another step may include forcing the chilled air through the duct system, over the plurality of fins, and through the diverter such that the chilled air is unevenly distributed through the diverter in a predetermined pattern.

According to another aspect, the method may further include a step of chilling the air to about −15.5° F. and providing the chilled air at a flow rate of about 5.5 cubic feet per minute.

According to still other aspects, the method may include a step of positioning the diverter over the ice tray such that each of the plurality of slots is offset from a centerline of the diverter.

It will be understood by one having ordinary skill in the art that construction of the described disclosure and other components is not limited to any specific material. Other exemplary examples of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

Furthermore, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected" or "operably coupled" to each other to achieve the desired functionality, and any two components capable of being so associated can also be viewed as being "operably coupleable" to each other to achieve the desired functionality. Some examples of operably coupleable include, but are not limited to, physically mateable and/or physically interacting components and/or wirelessly interactable and/or wirelessly interacting components and/or logically interacting and/or logically interactable components. Furthermore, it will be understood that a component preceding the term "of the" may be disposed at any practicable location (e.g., on, within, and/or externally disposed from the appliance) such that the component may function in any manner described herein.

As used herein, the term "about" means that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art. When the term "about" is used in describing a value or an end-point of a range, the disclosure should be understood to include the specific value or end-point referred to. Whether or not a numerical value or end-point of a range in the specification recites "about," the numerical value or end-point of a range is intended to include two embodiments: one modified by "about," and one not modified by "about." It will be further understood that the end-points of each of the ranges are significant both in relation to the other end-point, and independently of the other end-point.

It is also important to note that the construction and arrangement of the elements of the disclosure as shown in the exemplary examples is illustrative only. Although only a few examples of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connectors or other elements of the system may be varied, the nature or number of adjustment positions provided between the elements may be varied. It should be noted that the elements and/or assemblies of the system might be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary examples without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structures and methods without departing from the concepts of the present disclosure, and further it is to be understood that such concepts are intended to be covered by the following claims unless these claims by their language expressly state otherwise.

What is claimed is:

1. An icemaker for a refrigerated appliance, the icemaker comprising:

an ice tray having a top surface and at least one ice-forming compartment arranged along a central axis; and a duct operably coupled with a diverter for directing air, the diverter comprising:

a base spaced away from the top surface of the ice tray and having first and second sides, the base defining a plurality of slots, wherein the slots are offset from the central axis of the ice tray and each of the slots at least partially crosses the central axis of the ice tray;

at least one spacing portion extending between two of the plurality of variously sized slots; and at least one fin extending away from a top surface of the base.

2. The icemaker of claim 1, wherein each of the plurality of slots is offset from a centerline of the diverter, the centerline of the diverter aligned with the central axis of the ice tray.

3. The icemaker of claim 1, wherein the plurality of slots includes at least a first slot, a second slot, and a third slot.

4. The icemaker of claim 3, wherein the first slot has a first area and the second slot has a second area, wherein the second area is less than the first area, and further wherein the second slot is disposed on an opposing side of the first slot from the duct.

5. The icemaker of claim 4, wherein the third slot has a third area less than the first area and greater than the second area, and further wherein the third slot is positioned on an opposing side of the second slot from the first slot.

6. The icemaker of claim 3, wherein the at least one spacing portion includes a first spacing portion extending between the first slot and the second slot and a second spacing portion extending between the second slot and the third slot.

7. The icemaker of claim 6, wherein the first spacing portion has a length of about 20 mm to about 25 mm.

8. The icemaker of claim 6, wherein the second spacing portion has a length of about 30 mm to about 35 mm.

9. The icemaker of claim 1, wherein the plurality of slots extend in a direction perpendicular to the central axis of the ice tray.

10. An icemaker for a refrigerated appliance, the icemaker comprising:

an ice tray having a top surface and a plurality of ice-forming compartments arranged along a central axis;

a duct system having upper and lower baffles, wherein the upper baffle directs air above the ice tray; and a diverter positioned parallel above and spaced apart from the ice tray and defining a plurality of slots therein, wherein the plurality of slots are offset from the central axis of the ice tray and each slot extends in a direction perpendicular to the central axis of the ice tray.

11. The icemaker of claim 10, wherein the plurality of slots includes a first slot, a second slot, and a third slot, and further wherein each of the plurality of slots has one of a first area, a second area, and third area, respectively.

12. The icemaker of claim 11, wherein each of the first area, the second area, and the third area are different.

13. The icemaker of claim 10, wherein a fin extends from a base of the diverter in a direction opposite of the ice tray and is configured to affect the flow of the chilled air through the plurality of slots.

14. The icemaker of claim 10, wherein chilled air from the duct system is directed through the plurality of slots to the ice tray.

15. The icemaker of claim 10, wherein the diverter includes at least one spacing portion.

16. The icemaker of claim 15, wherein the at least one spacing portion includes a first spacing portion extending between the first slot and the second slot and having a first length and a second spacing portion extending between the second slot and the third slot and having a second length.

17. The icemaker of claim 16, wherein the first length is less than the second length.

18. A method for forming ice, comprising steps of:

generating chilled air;

positioning a plurality of fins within a duct;

defining a plurality of slots within a base of a diverter;

coupling the duct with the diverter;

positioning the diverter over an ice tray having a plurality of ice forming compartments;

filling the plurality of ice forming compartments with water; and directing the chilled air through the duct and over the plurality of fins, and further directing the chilled air through the diverter such that the chilled air is unevenly distributed through the diverter.

19. The method for forming ice of claim 18, further comprising the step of:

chilling the air to a temperature of about −5° F. to about −20° F. and providing the chilled air at a flow rate of about 4 cubic feet per minute to about 6 cubic feet per minute.

20. The method for forming ice of claim 18, further comprising the step of:

defining the plurality of slots such that each of the plurality of slots is offset from a centerline of the diverter.

* * * * *